US011395950B2

(12) United States Patent
Jones et al.

(10) Patent No.: US 11,395,950 B2
(45) Date of Patent: Jul. 26, 2022

(54) ADJUSTABLE DOUBLE END BAG

(71) Applicant: XFIT, LLC, Austin, TX (US)

(72) Inventors: Terry G. Jones, Austin, TX (US); Brian Bates, Austin, TX (US)

(73) Assignee: XFit, Inc.

( * ) Notice: Subject to any disclaimer, the term of this patent is extended or adjusted under 35 U.S.C. 154(b) by 187 days.

(21) Appl. No.: 16/845,665

(22) Filed: Apr. 10, 2020

(65) Prior Publication Data

US 2020/0238148 A1 Jul. 30, 2020

Related U.S. Application Data

(63) Continuation of application No. 15/312,065, filed as application No. PCT/US2014/061370 on Oct. 20, 2014, now abandoned.

(60) Provisional application No. 62/000,180, filed on May 19, 2014.

(51) Int. Cl.

| | |
|---|---|
| ***A63B 69/20*** | (2006.01) |
| ***A63B 71/06*** | (2006.01) |
| ***A63B 21/16*** | (2006.01) |
| ***A63B 24/00*** | (2006.01) |

(52) U.S. Cl.

CPC ..... *A63B 69/206* (2013.01); *A63B 21/1654* (2013.01); *A63B 21/1663* (2013.01); *A63B 24/0062* (2013.01); *A63B 24/0075* (2013.01); *A63B 71/0622* (2013.01); *A63B 2220/12* (2013.01); *A63B 2220/40* (2013.01); *A63B 2220/803* (2013.01); *A63B 2225/093* (2013.01); *A63B 2225/50* (2013.01)

(58) Field of Classification Search

CPC ..... A63B 21/1654; A63B 21/1663; A63B 24/0062; A63B 24/0075; A63B 69/20; A63B 69/201; A63B 69/203; A63B 69/205; A63B 69/206; A63B 69/208; A63B 69/24; A63B 69/26; A63B 69/32; A63B 69/325; A63B 71/0622; A63B 2209/10; A63B 2210/12; A63B 2210/40; A63B 2210/803; A63B 2225/055; A63B 2225/093; A63B 2225/50; A63B 2225/62

See application file for complete search history.

(56) References Cited

U.S. PATENT DOCUMENTS

| | | | | |
|---|---|---|---|---|
| 341,231 | A * | 5/1886 | Goodman | A63B 69/004 482/89 |
| 5,056,784 | A * | 10/1991 | Craig | A63B 69/0084 473/426 |
| 5,554,088 | A * | 9/1996 | Zlojutro | A63B 71/023 482/89 |
| 8,012,047 | B2 * | 9/2011 | Gamboa | A63B 69/345 473/445 |
| 2004/0110607 | A1 * | 6/2004 | Crespo | A63B 69/206 482/89 |

(Continued)

*Primary Examiner* — Joshua Lee

(74) *Attorney, Agent, or Firm* — The Law Firm of H. Dale Langley, Jr., PC

(57) ABSTRACT

A vertically adjustable double end bag system includes a double end bag connected to a tether. The tether may be a continuous cord o two connected cords, and may be flexible or substantially fixed length. The double end bag includes an adjuster mechanism for selectively positioning the bag. A support, such as may be connected to a door or other upright fixture or as may be free-standing via a base, connects to and suspends the tether.

9 Claims, 3 Drawing Sheets

(56) References Cited

U.S. PATENT DOCUMENTS

| | | | | |
|---|---|---|---|---|
| 2011/0172060 | A1* | 7/2011 | Morales | A63B 69/004 482/8 |
| 2012/0053016 | A1* | 3/2012 | Williamson | A63B 24/0062 482/84 |
| 2012/0252637 | A1* | 10/2012 | Pellot | A63B 69/20 482/89 |
| 2013/0065735 | A1* | 3/2013 | Conarty | A63B 69/206 482/89 |
| 2015/0290518 | A1* | 10/2015 | Hudson | A63B 71/023 482/90 |

* cited by examiner

ADJUSTABLE DOUBLE END BAG

CROSS-REFERENCE TO RELATED APPLICATIONS

The present application is a conversion and has priority of U.S. Provisional Patent Application No. 62/000,180, titled "Adjustable Double End Bag", filed May 19, 2014 which application has at least one same inventor of the present application and such application is herein incorporated by this reference.

TECHNICAL FIELD

The invention generally relates to boxing equipment and more particularly relates to double end bags for boxing and punching.

BACKGROUND

A double end bag is typically a small punching bag suspended vertically by an upper cord attached to the bag and to the ceiling (or overhead structure) and a lower cord attached to the bag and the floor (or underlaid structure). Conventionally, the upper and lower cords are tied (or otherwise fixed) to the double end bag, to vertically fix the bag in position as determined by the length of the upper cord and the lower cord. The vertically suspended double end bag is punched and is held and maintained in vertical position by the upper and lower cords.

Conventional double end bags are substantially spherical in shape. When vertically suspended in use between the upper cord and lower cord, the upper cord is fixed (e.g., tied) at an upper pole of the bag and the lower cord is fixed (e.g., tied) at a lower pole of the bag. The double end bag may include a tether fixture, such as a loop or hook, at the opposing poles (upper and lower) of the bag. As suspended, the bag is retained in substantially vertical position and reflexes the upper and lower cord when the bag is punched.

The rounded surface of conventional double end bags may hamper punching efforts by less skilled boxers and for varied styles of punches or kicks. Punches and kicks which are off-center may sway the double end bag from side to side or may spin the bag. Learners can have difficulty effectively punching or kicking the double end bag in a routine or workout. Moreover, certain styles or types of punches or kicks may not be effectively perfected or exercised with a round double end bag.

It would be an improvement to provide retrofit and stand-alone assemblies for vertically suspending a double end bag. It would further be an improvement to vary the spherical bag for different types of punches or kicks to the bag, or levels of expertise of the boxer. It would further be an improvement to provide an interactive routine for double bag workouts.

SUMMARY

An embodiment of the invention is a vertically adjustable double end bag system. The system includes a double end bag connected to a tether. The double end bag includes an adjuster mechanism for selectively positioning the bag on the tether. An upper support and lower support, such as may be connected to a door, wall, or other upright, are connected to and suspend the tether. A sheath may be connected to surround the bag. The sheath surrounds the bag to provide a varied surface (i.e., flat or planar) and shape for punching, for example, a square, oval, larger round, triangle or other shape. A sensor is connected to the bag. The sensor is communicatively connected to a processing device. The processing device includes or communicatively connects to a computer program. The computer program processed by the processing device is, for example, an app that provides interactive video and gaming, interval training, performance metrics, dynamic coaching and workout history.

Another embodiment of the invention is a system for boxing and exercise including a bag having a top and a bottom, a tether connected to the top and the bottom of the bag, and a vertical adjuster for selectively positioning the bag in connection to the tether.

Yet another embodiment of the invention is a system for boxing and training including a double end bag, and a removable cover surrounding the double end bag, the removable cover provides at least one flat surface.

Another embodiment of the invention is a system for boxing and exercise including a bow, an upper cord slidably connected to the bow, a lower cord slidably connected to the bow, and a double end bag having a top and a bottom, the top of the double end bag connected to the upper cord and the bottom of the double end bag connected to the lower cord.

BRIEF DESCRIPTION OF THE DRAWINGS

The present invention is illustrated by way of example and not limitation in the accompanying figures, in which like references indicate similar elements, and in which.

DETAILED DESCRIPTION

The following description refers to certain specific embodiments; however, the specific embodiments are merely illustrative and variations and changes may be made in the embodiments without diverting from the broad scope encompassed by the disclosure.

Figure 1:
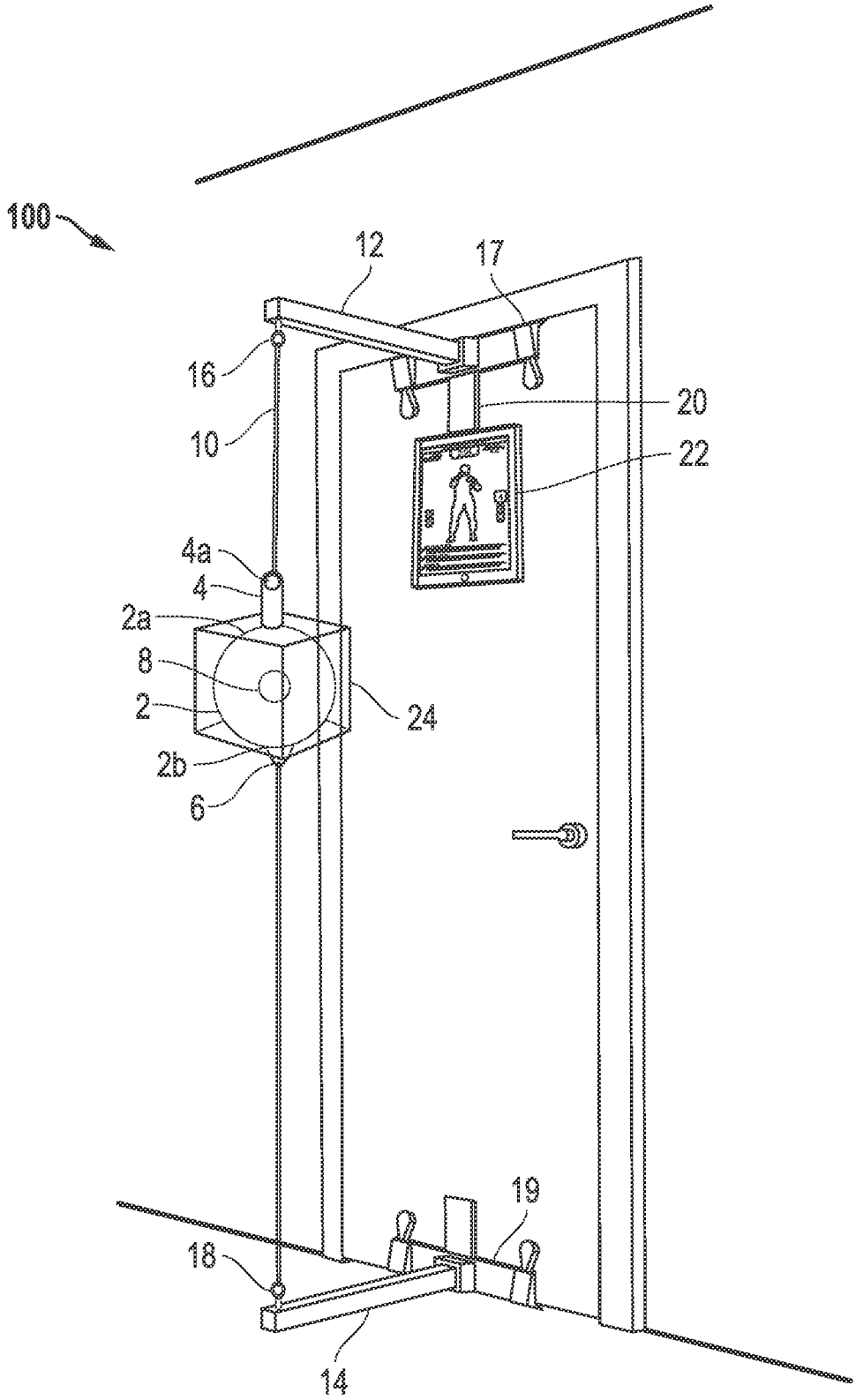
FIG. 1 illustrates a perspective view of a vertically adjustable double end bag system, according to certain embodiments.

Referring to FIG. 1, a system 100 includes a punching bag 2 having a top 2*a* and a bottom 2*b*. The punching bag 2 is generally spherical in shape, having a leather, plastic, rubber or leather substitute shell, and containing a pressurized fluid or gas, for example, air, or a foam or other filling. The bag 2 may include a bladder (not shown) within the shell, for containing the pressurized fluid, gas or other filling. The bag is formed with a centralized throughway from top 2*a* to bottom 2*b*, suitable to accommodate an extended length of a tether 10 through the bag 2. The pressurized fluid or gas (or foam or other filling) is sealed within the shell and from the throughway.

The bottom 2*b* of the bag 2 connects to a ring 6 for retaining the bottom 2*b* of the bag to tether 10. The top 2*a* of the bag 2 connects to an adjuster mechanism 4. The adjuster mechanism 4 crimps the tether 10 for fixing the bag 2 in position along length of the tether 10. The adjuster mechanism 4 includes an actuator 4*a* which can be manually activated by touch to release crimp by the adjuster mechanism 4, allowing the bag 2 to be positioned vertically (in FIG. 1) along the tether 10.

Connected internally to the bag 2, or alternately, positioned in or on the shell of the bag 2, is a sensor 8, for example, an accelerometer, GPS device, or other position or movement sensor. The sensor 8 is, for example, a multi-axis (e.g., 3-axis) accelerometer, capable of detecting spatial movement of the bag 2 in use for boxing. As will become understood, the sensor 8 is communicatively connected, by wire or wireless channel, to a processing device 22, such as a tablet, smart phone or other processor device.

The system 100 may include an upper support 12 and a lower support 14. The tether 10 is connected at extents of its length (e.g., by ends of the tether 10) to rings 16, 18, or other fixtures of the upper support 12 and the lower support 14. In use of the system 100, the tether 10 is connected, for example, at an upper (vertically in FIG. 1) extent to the ring 16 of upper support 12. Also in use, the tether 10 is connected, for example, at a lower extent to the ring 18 of lower support 14.

In certain non-exclusive embodiments, the upper support 12 includes an upper fixture 17 for connecting the upper support 12 to a door or similar upright. The upper fixture 17 may be generally inverted U-shaped and perpendicular to an extending arm of the upper support 12 forming a T. The generally inverted U-shape of the upper fixture 17 may accommodate an edge (e.g., upper edge) of the door or similar upright. The lower support 14 similarly includes a lower fixture 19. The lower fixture 19 may be generally U-shaped and perpendicular to an extending arm of the lower support 14 forming a T. The generally U-shape of the lower fixture 19 may accommodate an edge (e.g., lower edge) of the door or similar structure. In alternatives, the upper support 12 and the lower support 14 may be attached, for example, by suction cups, screws, grips, or other attachments, to a wall or similar vertical structure, in which cases the U-shape features are not employed for accommodating edges.

A mounting bracket 20 may be connected to or included in the upper support 12. The mounting bracket 20 may be an extension of the upper fixture 17. The mounting bracket 20 accepts for mounting therewith/thereon, the tablet, smart phone or other processing device 22.

In operation, the lower fixture 19 is attached to an edge, for example, the bottom edge of a door. The upper fixture 17 is attached to another edge, for example, the upper edge of the door. In such attachment, the upper support 12 and the lower support 14 each extends protruding from the surface of the door or other structure to which attached. Respective ends of the tether 10 (with the bag 2 disposed between the ends along the tether 10) are connected to the rings 16, 18, respectively, such that the tether 10 is tautly suspended between the rings 16, 18.

If desired, the bag 2 is then varied in position (e.g., vertical position) along the tether 10. The actuator 4*a* of the adjuster mechanism 4 is pressed (or otherwise deactivated) to release crimp of the tether 10. The bag 2 is moved along the tether 10 as desired. When the bag 2 is positioned as desired, the adjuster mechanism 4 is reactivated to crimp the tether 10, for example, by release of the pressed actuator 4*a*.

Once the bag 2 is positioned, boxing practice may commence.

In certain non-exclusive embodiments, the sensor 8 of the bag 2 communicatively connects to the processing device 22, such as a tablet device, smart phone or other processing device. The processing device 22 includes a processor, memory and a computer program stored in the memory. The computer program is, for example, an app that provides interactive video and gaming, interval training, performance metrics, dynamic coaching and workout history.

The processing device 22 (e.g., a tablet, smart phone or other device) may be mounted on the mounting bracket 20. A wired or wireless (e.g., 802.11, Bluetooth™, infrared, or other) connection communicatively connects the sensor 8 to the processing device 12. The processing device 12 receives measurements from the sensor 8, and those measurements operate as input to the computer program processed by the processing device 12. The computer program, processed by the processing device 12 together with measurements of the sensor 8, provides interactive training and routines, performance metrics and workout histories.

Figure 2:
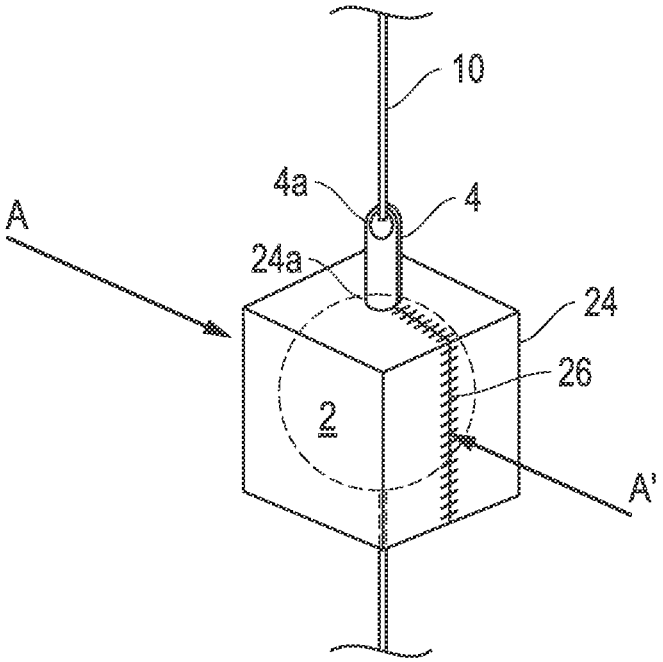
FIG. 2 illustrates a perspective view of a sheath cover of a double end bag, according to certain embodiments.

Referring to FIG. 2, in conjunction with FIG. 1, a sheath 24, for example, a square, rectangle, triangle or other shape, is connected to the double end bag 2. The sheath 24 surrounds and contains the double end bag 2. The sheath 24 is, for example, a bladder that may be placed around the bag 2 and inflated by liquid or gas (e.g., air). Alternately, the sheath 24 may be filled with material for punching, such as material fill for a medicine bag, punching bag, or the like.

The sheath 24 may include an opening 26 sufficient to accommodate the bag 2. When the sheath 24 is placed around the bag 2, the opening 26 may be closed by a connector 28, such as, for example, a zipper, Velcro™, snaps or other connection device. When the opening 26 is so closed by the connector 28, the sheath 24 maintains the bag 2 within the sheath 24. The sheath 24 may be formed with opening(s) 24*a* to accommodate devices, such as the adjuster mechanism 4 of the top 2*a* of the bag 2 and the ring 6 of the bottom 2*b* of the bag 2, and to allow passage of the tether 10 through the sheath 24.

Figure 3:
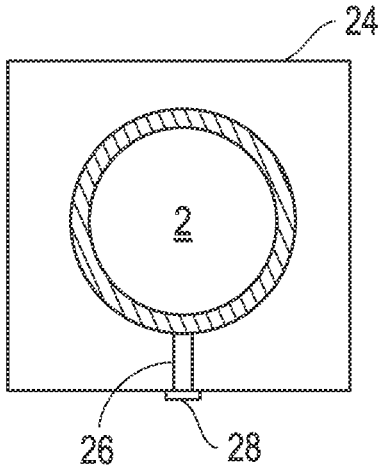
FIG. 3 illustrates a cross-section along line A-A' of FIG. 2, or a sheath cover of a double end bag, according to certain embodiments.

Referring to FIG. 3, in conjunction with FIGS. 1 and 2, the bag 2 is contained by the sheath 24. The sheath 24 closely surrounds the bag 2 in contact with it. The sheath 24 is retained around the bag by the connector 28.

Various shapes are possible for the sheath 24, for example, the sheath may be square, round, oval, rectangle, or other shape in place on the bag 2. The sheath 24 may be a variety of materials and configurations, for example, the sheath 24 may be leather, leather simulation, plastic, rubber or the like, with or forming an internal air bladder or containing fill materials.

In use, the boxer may punch the sheath 24 in place around the bag 2. The sheath 24 may permit particular punch training, training of less experienced boxers, and other possibilities.

In non-exclusive alternatives, the upper and lower supports may be replaced by a floor stand which includes a base and upright, and suspends the bag 2 from an arm or similar appendage. The floor stand may include a mount or other fixture for holding the processing device. In other alternatives, the sheath 24 of the bag 2 may be of any of a variety of shapes and configurations, such as square, cuboid, round, oval, spherical, or combinations of varied surfaces to provide for desired surface(s) for punching or kicking.

Figure 4:
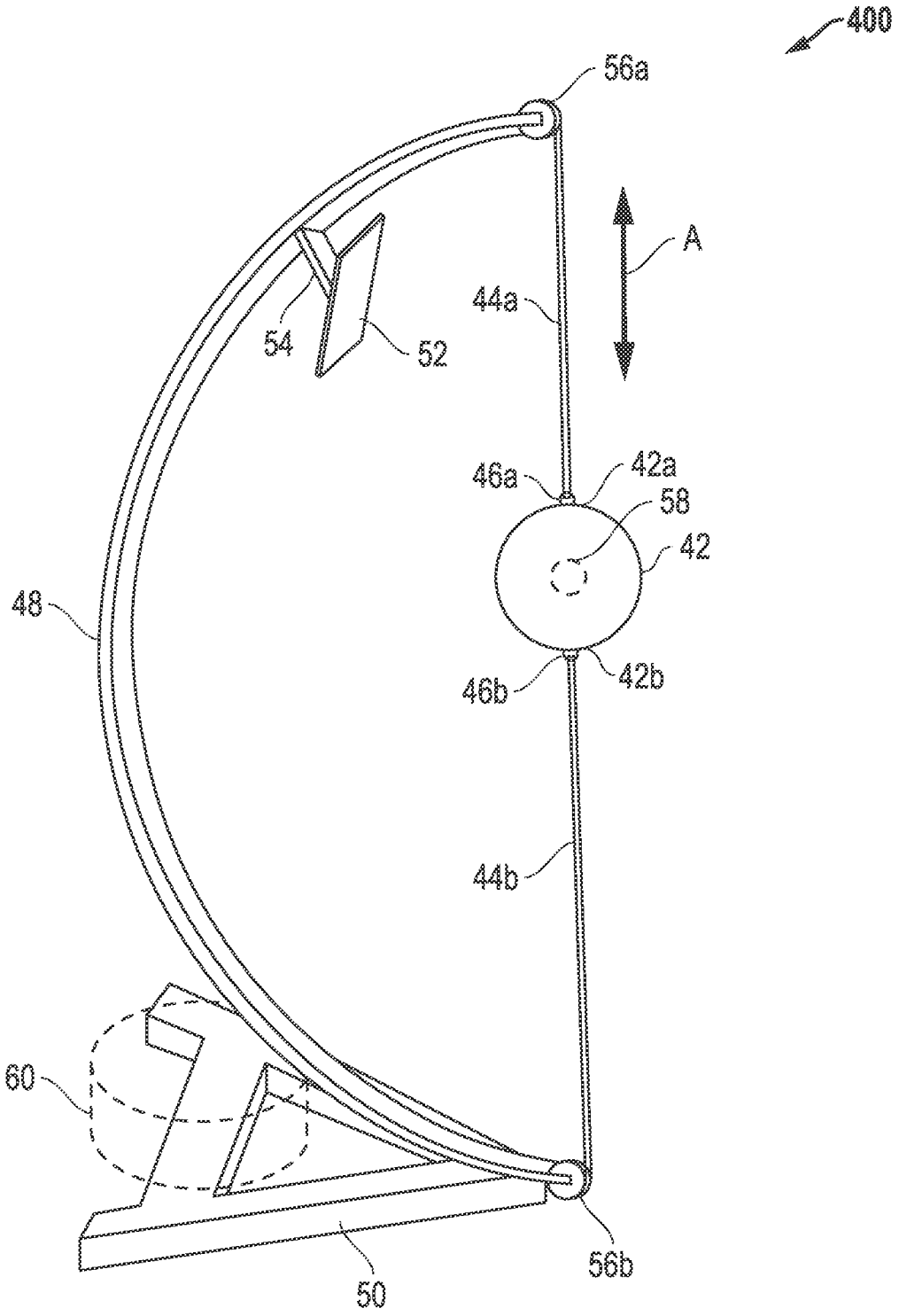
FIG. 4 illustrates an alternative embodiment of a bow and floor stand for suspending a double end bag, according to certain embodiments.

Referring to FIG. 4, in other non-exclusive alternatives, a system 400 includes a punching bag 42 having a top 42*a* and a bottom 42*b* suspended by upper and lower cords 44*a*, 44*b*, respectively, from a bow support 48. The punching bag 42 is generally spherical in shape, having a leather, plastic, rubber or leather substitute shell, and containing a pressurized fluid or gas, for example, air, or a foam or other filling. The bag 42 may include a bladder (not shown) within the shell, for containing the pressurized fluid, gas or other filling. The bag 42 is connected at the top 42*a* to the upper cord 42*a*, and at the bottom 42*b* to the lower cord 42*b*. The pressurized fluid or gas (or foam or other filling) is sealed within the shell.

The bottom 42*b* of the bag 42 connects to a lower ring 46*b* or similar device (e.g., hook, grommet, or other) for retaining the bottom 42*b* of the bag 42 to the lower cord 42*b*. The top 42*a* of the bag 42 connects to an upper ring 46*a* or similar device (e.g., hook, grommet, or other) for retaining the top 42*a* of the bag 42 to the upper cord 42*a*. In certain embodiments the upper cord 42*a* extends through or rides along the bow support 48 to connect to the lower cord 42*b*, which similarly extends through or rides along the bow support 48. The upper cord 42*a* may be a flexible length of tether or cord, for example, a rubber, polymer or other elastic line or link. The lower cord 42*b* may be a substantially fixed length of rope or cord, for example, a hemp, linen, cotton, nylon, or similar braided or unbraided fibers. In alternatives, the upper and lower cords 42*a*,42*b* may be any of fixed length, non-flexible, non-elastic, flexible, elastic, and combinations.

Connected internally to the bag 42, or alternately, positioned in or on the shell of the bag 42, is a sensor 58, for example, an accelerometer, GPS device, or other position or movement sensor. The sensor 58 is, for example, a multi-axis (e.g., 3-axis) accelerometer, capable of detecting spatial movement of the bag 42 (as suspended by the upper and lower cords 42*a*, 42*b*) in use for boxing. As will become understood, the sensor 58 is communicatively connected, by wire or wireless channel, to a processing device 52, such as a tablet, smart phone or other processor device.

The bow support 48 vertically stands from a base frame 50 connected to a lower end of the bow support 48. The bow support 48 is bow-shaped (e.g., semi-circular or elliptical) and may be substantially rigid or flexible, as desired in the embodiment. The bow support 48 is, for example, formed of steel, iron, graphite, composite or other materials. The upper and lower cords 44*a*, 44*b* are connected to the bow support 48, for example, an upper roller 56*a* and a lower roller 56*b* are connected at extents of the bow support 48 for guiding the upper and lower cords 44*a*, 44*b* respectively. The upper and lower cords 44*a*, 44*b* may travel through or ride adjacent the bow support, and connect therein or thereon. As may be understood, the bag 42 may be raised or lowered by moving/sliding the upper and lower cords 44*a*, 44*b* in the directions of arrow A. When the bag 42 is in use for boxing, the bag 42 is retained in relatively fixed vertical position by the upper and lower cords 44*a*, 44*b*.

The bow support 48 is connected to the base frame 50. The base frame 50 is configured to vertically support the bow support 48 during use of the bag 42 for boxing. A non-exclusive example of the base support 50 includes V-shaped legs extending generally perpendicular to the vertically supported bow support 48. The V-shaped legs may be connected by a mediate bar. Although the base support 50 may be configured sufficient to vertically support the bow support 48 during boxing use, additional weights 60, for example, disks weights, liquid filled bladder weight, or the like, may be placed atop the base support 50 to aid stability.

The bow support 48 may additionally connect to a device support 54, for example, a support for an electronic tablet, smart phone, display, or similar processing device 52. The device support 54 is positioned at approximately head-height of a boxer using the system 400 for boxing. The device support 54 may be adjustable to allow varied positioning and tilt to the supported processing device 52. The device support 54 may be removably or fixably attached to the bow support 48, or alternately, the device support 54 may be separate or not included in the system 400.

In operation, the base frame 50 of the bow support 48 is positioned on an underlying surface, such as a floor. If desired, the bag 42 is vertically repositioned via the upper and lower cords 44*a,b*, by sliding the cords 44*a,b* along the roller 56*a,b*. The processing device 52 is mounted to the device support 54 and selectively positioned at about head-height for the boxer user. Once the bag 42 is positioned, boxing practice may commence.

The sensor 58 of the bag 42 communicatively connects to the processing device 52. The processing device 52 includes a processor, memory and a computer program stored in the memory. The computer program is, for example, an app that provides interactive video and gaming, interval training, performance metrics, dynamic coaching, workout history and/or other interactive features. A wired or wireless (e.g., 802.11, Bluetooth™, infrared, or other) connection communicatively connects the sensor 58 to the processing device 52. The processing device 52 receives measurements from the sensor 58, and those measurements operate as input to the computer program processed by the processing device 52. The computer program, processed by the processing device 52 together with measurements of the sensor 58, provides interactive training and routines, performance metrics and workout histories.

As will be understood, though a processing device, such as a tablet, smart phone, display, or other processor device, may be employed in use and operation of the embodiments, the systems and methods may alternately be employed without the processing device for free-form boxing and workout routines.

In the foregoing, the invention has been described with reference to specific embodiments. One of ordinary skill in the art will appreciate, however, that various modifications, substitutions, deletions, and additions can be made without departing from the scope of the invention. Accordingly, the specification and figures are to be regarded in an illustrative rather than a restrictive sense, and all such modifications substitutions, deletions, and additions are intended to be included within the scope of the appended claims. Any benefits, advantages, or solutions to problems that may have been described above with regard to specific embodiments, as well as device(s), connection(s), step(s) and element(s) that may cause any benefit, advantage, or solution to occur or become more pronounced, are not to be construed as a critical, required, or essential feature or element.

What is claimed is:

1. A system for boxing and exercise, comprising:

a bag having a top and a bottom;

a bow;

an upper cord slidably connected to the bow;

a lower cord slidably connected to the bow, the top of the bag connected to the upper cord and the bottom of the bag connected to the lower cord;

a sensor connected to the bag;

a mount connected to the bow; and a processor device connected to the mount and communicatively connected to the sensor, the processor device providing interactive instructions responsive to striking of the bag by a user, the interactive instructions individualized for the user.

2. The system of claim 1, wherein the processor device includes a memory containing a set of instructions, a processor for processing the set of instructions, and an output device for delivering commands per the set of instructions based on interactions of the user with the bag as detected by the sensor, wherein the set of instructions include:

outputting a training exercise command;

outputting a boxing routine command;

calculating a boxing performance metric based on strikes to the bag; and storing workout history in the memory.

3. A system for boxing and exercise, comprising:

a bow;

an upper cord slidably connected to the bow;

a lower cord slidably connected to the bow;

a double end bag having a top and a bottom, the top of the double end bag connected to the upper cord and the bottom of the double end bag connected to the lower cord;

a sensor connected to the double end bag;

a processor device communicatively connected to the sensor; and a mount connected to the bow for retaining the processor device during use of the system.

4. The system of claim 3, further comprising:

an underlying base connected to the bow for vertically positioning the bow with the double end bag vertically suspended by the upper cord and the lower cord.

5. The system of claim 3, wherein the processor device includes a memory containing a set of instructions, a processor for processing the set of instructions, and an output device for delivering interactive commands per the set of instructions, wherein the set of instructions include:

outputting a training exercise by the output device;

outputting a boxing routine by the output device;

calculating a boxing performance metric based on strikes to the bag; and storing workout history in the memory.

6. The system of claim 3, wherein the upper cord is elastic and the lower cord has a substantially fixed length.

7. The system of claim 3, wherein the lower cord is elastic and the upper cord has a substantially fixed length.

8. The system of claim 3, further comprising:

a weight connected to the underlying base.

9. The system of claim 4, further comprising:

a weight connected to the underlying base.

* * * * *